US006249199B1

(12) United States Patent
Liu

(10) Patent No.: US 6,249,199 B1
(45) Date of Patent: Jun. 19, 2001

(54) QUICK MAGNETIZING AND DEMAGNETIZING DEVICE FOR SCREWDRIVERS

(76) Inventor: George Liu, 6F-3, No. 185, Gon Yi Rd., Sec. 2, Nan Twen District, Taichung City (TW)

( * ) Notice: Subject to any disclaimer, the term of this patent is extended or adjusted under 35 U.S.C. 154(b) by 0 days.

(21) Appl. No.: 09/546,642

(22) Filed: Apr. 10, 2000

(51) Int. Cl.[7] ..... H01F 13/00; H01F 7/20
(52) U.S. Cl. ..... 335/284; 335/306
(58) Field of Search ..... 335/284, 285, 335/286, 296–306; 7/901

(56) References Cited

U.S. PATENT DOCUMENTS 3,467,926 * 9/1969 Smith ..... 335/284
5,502,425 * 3/1996 Tsai ..... 335/304

* cited by examiner

*Primary Examiner*—Ray Barrera

(74) *Attorney, Agent, or Firm*—Dougherty & Troxell

(57) ABSTRACT

Quick magnetizing and demagnetizing device for screwdrivers, including two symmetrical outer casings mated with each other and two sintered magnets. The upper and a lower sections of the interior of each of the outer casings are respectively formed with two receiving cavities. With the identical poles opposite to each other, the two sintered magnets are respectively received in the upper and lower receiving cavities of the outer casings. The engaging ribs formed in the receiving cavities engage with and fix the sintered magnets therein. When a screwdriver with magnetism is abraded back and forth against the demagnetizing face of the outer casings and at the same time rotated, the screwdriver is demagnetized for use in computer equipment or sophisticated instrument. When the demagnetized screwdriver is fitted into the screwdriver socket of the outer casings between the two sintered magnets and abraded back and forth therein and rotated at the same time, the magnetism of the screwdriver is restored. Therefore, the screwdriver can be quickly and conveniently demagnetized and magnetized. The quick magnetizing and demagnetizing operation can be easily performed and the application range of the quick magnetizing and demagnetizing device is wider.

2 Claims, 3 Drawing Sheets

QUICK MAGNETIZING AND DEMAGNETIZING DEVICE FOR SCREWDRIVERS

BACKGROUND OF THE INVENTION

The present invention relates to a quick magnetizing and demagnetizing device for screwdrivers, which is able to quickly and conveniently demagnetize screwdrivers for use in magnetically sensitive computer equipment or sophisticated instrument. The quick magnetizing and demagnetizing operation also can quickly and conveniently magnetize the screwdrivers for attracting screws.

FIG. 1 shows a conventional screwdriver with magnetism. In the case of fine screw or narrow locking position, an operator can hardly hold the screw with a hand and tighten the screw with a screwdriver. Therefore, during manufacturing, the entire metallic stem 11 or the front end of the metallic stem 11 of the existing screwdriver 10 is generally directly magnetized to form a magnetic section 12. In use of such screwdriver 10, the magnetic section 12 is able to attract the screw to facilitate tightening or untightening of the screw. However, after a long period of use or when subject to high temperature or violent shaking, the magnetism of the metallic stem 11 will gradually deteriorate or even disappear. This leads to inconvenience in use of the screwdriver. Also, when applied to computer equipment or sophisticated instrument, the magnetism of a magnetized screwdriver 10 will affect or even damage the computer equipment or sophisticated instrument. Therefore, the screwdriver 10 must be first demagnetized prior to use in the computer equipment or sophisticated instrument.

SUMMARY OF THE INVENTION

It is therefore a primary object of the present invention to provide a quick magnetizing and demagnetizing device for screwdrivers, including two outer casings mated with each other and two sintered magnets received in the outer casings. The quick magnetizing and demagnetizing device is able to quickly and conveniently demagnetize screwdrivers or magnetize the screwdrivers.

It is a further object of the present invention to provide the above quick magnetizing and demagnetizing device in which in cooperation with the resilient expansion of two lateral resilient sides of the outer casings and the inward contraction of the inclined faces thereof, the metallic stems of the screwdrivers with different diameters can be fitted into the screwdriver socket. Therefore, the application range of the quick magnetizing and demagnetizing device is wider.

It is still a further object of the present invention to provide the above quick magnetizing and demagnetizing device in which the two lateral convex resilient sides and the slightly concave demagnetizing faces of the outer casings enable a user to easily hold and operate the quick magnetizing and demagnetizing device.

The present invention can be best understood through the following description and accompanying drawings wherein:

DETAILED DESCRIPTION OF THE PREFERRED EMBODIMENT

Figure 2:
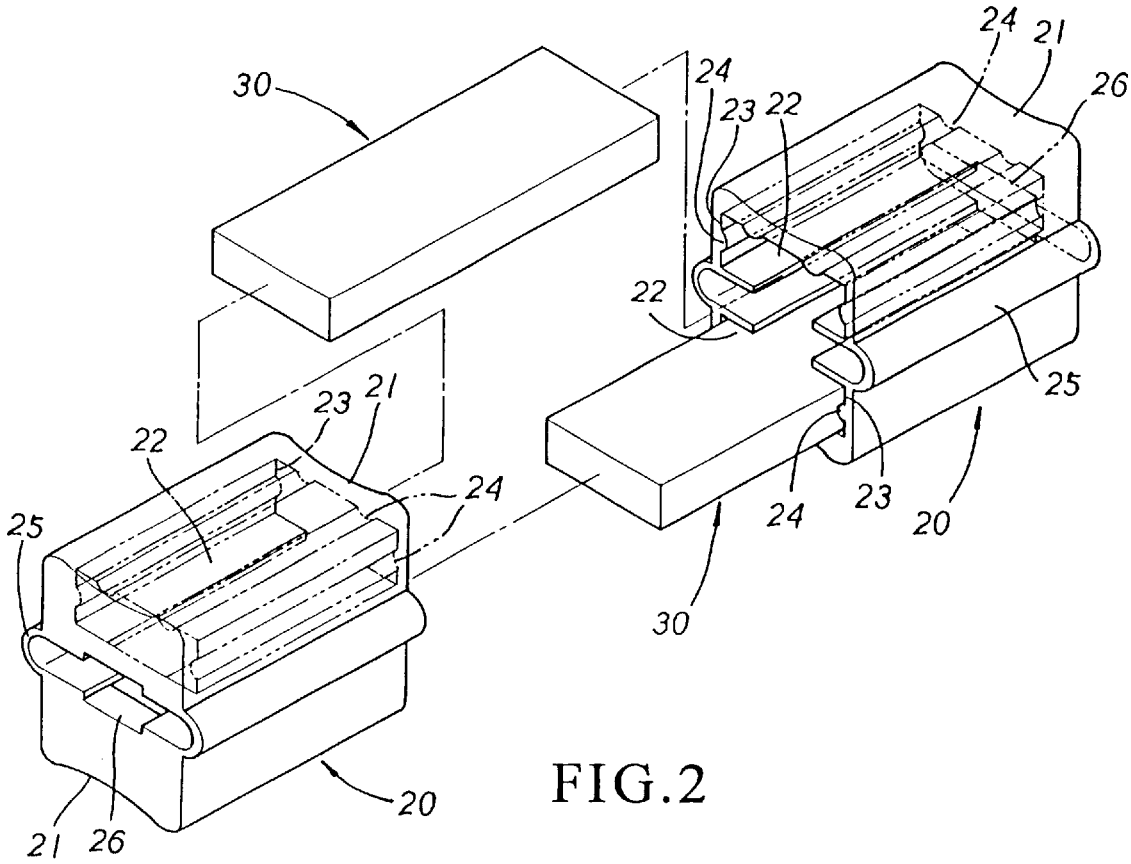
FIG. 2 is a perspective exploded view of the present invention.

Please refer to FIG. 2. The present invention includes two outer casings 20 and two sintered magnets 30. The outer casing 20 is made of rubber material. The upper and lower surfaces of the outer casing 20 are both formed with slightly concave demagnetizing faces 21. The upper and lower sections of the interior of the outer casing are respectively formed with two receiving cavities 22. Two lateral sides of the receiving cavity 22 are outward inclined faces 23. The top face and two lateral sides of the upper receiving cavity 22 and the bottom face and two lateral sides of the lower receiving cavity 22 are respectively formed with a certain number of engaging ribs 24. Two outer lateral sides of the central section of the outer casing 20 are outward convex faces. The interior of the center of the outer casing 20 is formed with an elongated elliptic through hole. The lateral convex face forms a resilient side 25. The center of the elliptic through hole communicates with the upper and lower receiving cavities 22. An outer end extending from the communicating portion forms a screwdriver socket 26 (for both cross-shaped screwdriver 10 and flat screwdriver 10 to fit therein ). The sintered magnet 30 is a long rectangular bar having a size about twice the dimension of the receiving cavity 22 of the outer casing 20.

Figure 3:
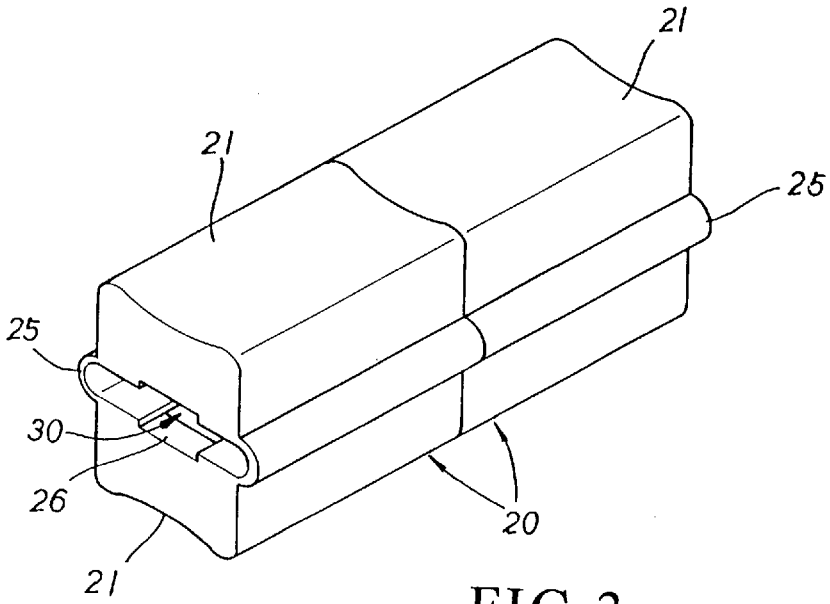
FIG. 3 is a perspective assembled view of the present invention.

Referring to FIG. 3, when assembled, under a condition that the identical poles are opposite to each other, the end sections of the two sintered magnets 30 are respectively inserted into the upper and lower receiving cavities 22 of one outer casing 20. The engaging ribs 24 in the receiving cavity 22 of the outer casing 20 serve to engage with and fix the magnets 30 in the cavities. (When the magnets 30 are inserted into the receiving cavities 22, the magnet 30 on lower side is lower than the screwdriver socket 26 of the outer casing 20, while the magnet 30 on upper side is higher than the screwdriver socket 26. The other end sections of the two magnets 30 are symmetrically inserted into the other outer casing 20 to complete the assembly.

Figure 4:
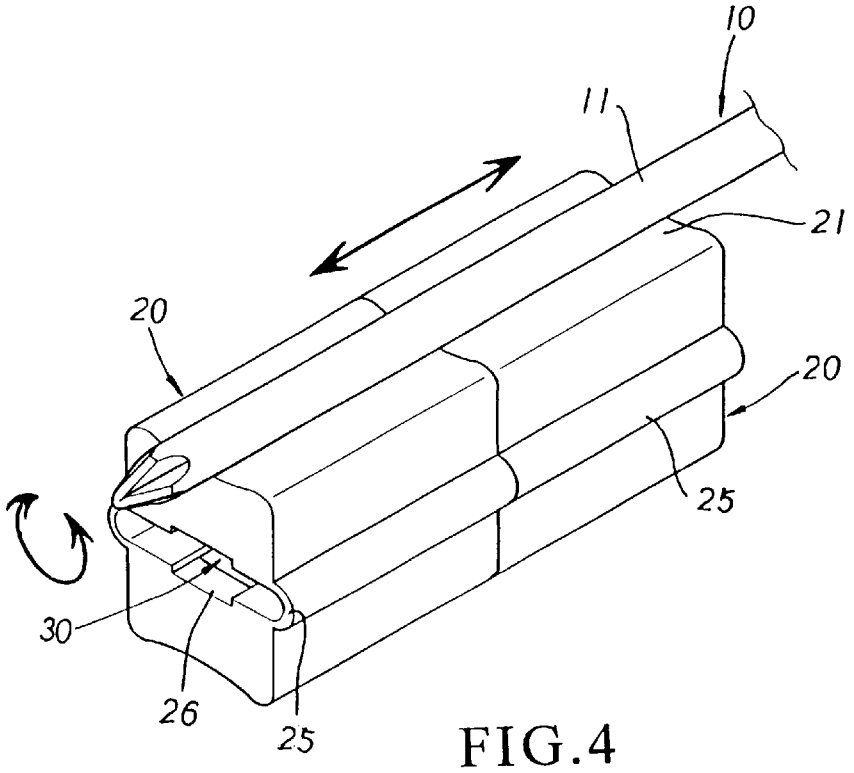
FIG. 4 shows the demagnetization operation of the screwdriver with the present invention.

FIG. 4 shows the demagnetization of the screwdriver. When demagnetizing the screwdriver 10, the metallic stem 11 of the screwdriver 10 is directly abraded back and forth against the demagnetizing face 21 of the outer casing 20 and at the same time rotated. Alternatively, the metallic stem 11 can hit the demagnetizing face 21 so as to demagnetize the metallic stem 11 of the screwdriver 10.

Figure 1:
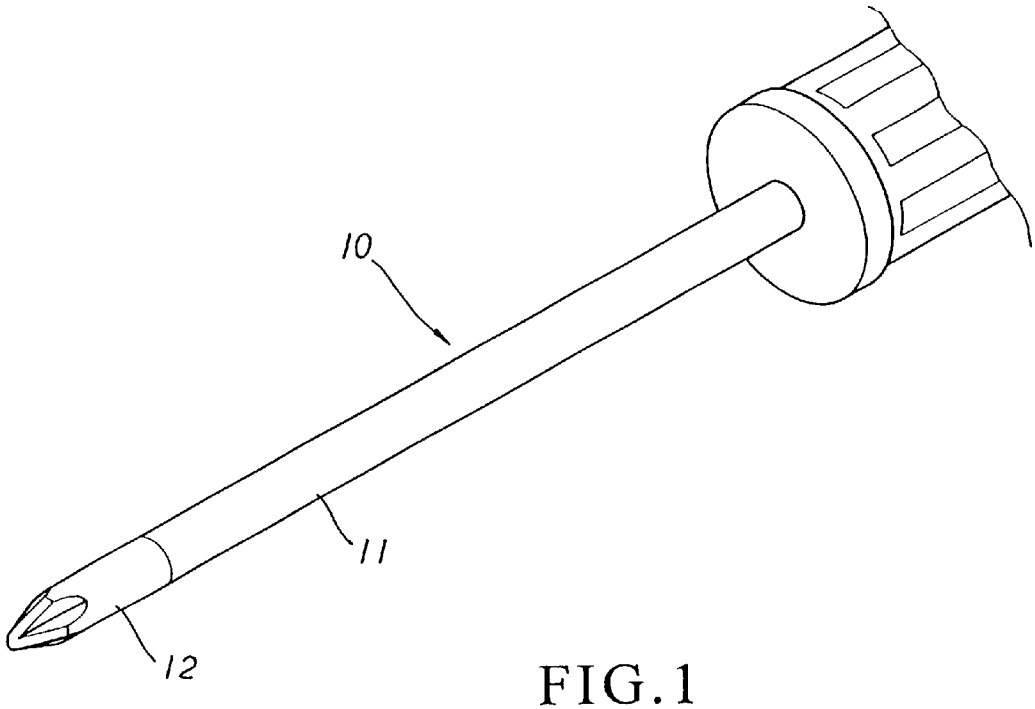
FIG.1 PRIOR ART
FIG. 1 is a perspective view of a conventional magnetized screwdriver.
Figure 6:
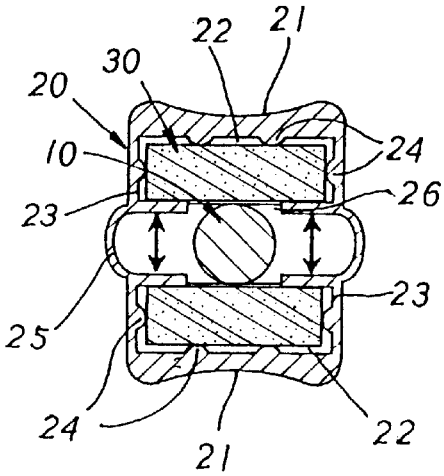
FIG. 6 is a sectional view showing the magnetization operation of the screwdriver with the present invention.
Figure 5:
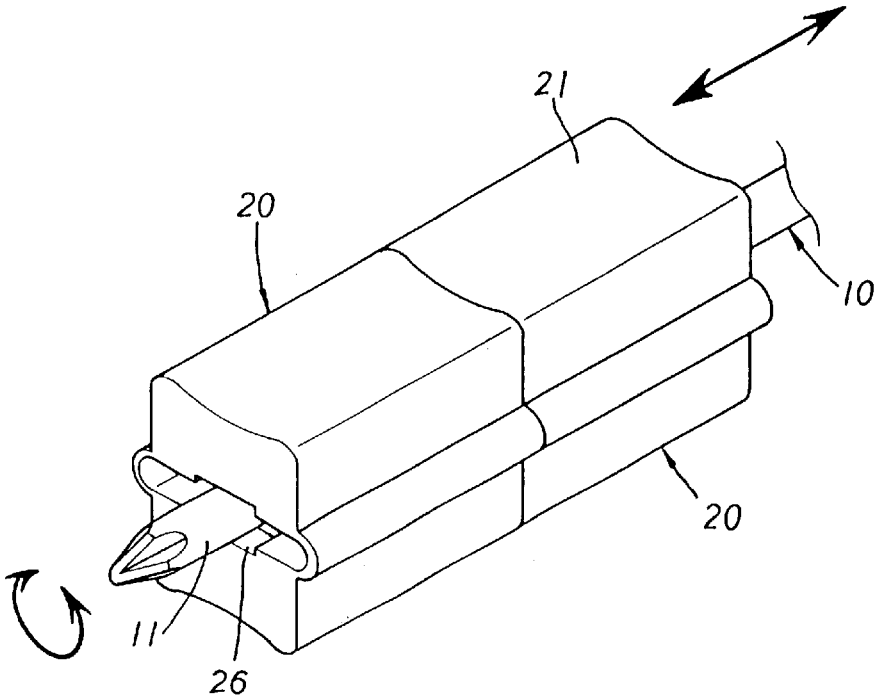
FIG. 5 shows the magnetization operation of the screwdriver with the present invention.

FIG. 5 shows the magnetization of the screwdriver. When magnetizing the screwdriver 10, the metallic stem 11 of the screwdriver 10 is directly fitted into the screwdriver socket 26 of the outer casing 20 and abraded back and forth therein and rotated at the same time. Under such circumstance, the magnetism of the screwdriver 10 can be restored. The two lateral resilient sides 25 of the outer casing 20 provide a resilient tolerance for inserting a metallic stem 11 with different diameter. FIG. 6 is a sectional view showing the magnetization of the screwdriver. In the case that a metallic stem 11 with larger diameter is inserted into the screwdriver socket 26 of the outer casing 20, the two lateral resilient sides 25 thereof will be resiliently expanded and the lateral inclined faces 23 in the receiving cavity 22 will at the same time slightly inward contracted.

According to the above arrangement, the present invention has the following advantages:

1. When the metallic stem 11 of the screwdriver 10 is abraded back and forth against the demagnetizing face 21 of the outer casing 20 and at the same time rotated, the screwdriver 10 is demagnetized. When the metallic stem 11 of the screwdriver 10 is directly fitted into the screwdriver socket 26 of the outer casing 20 and abraded back and forth therein and rotated at the same time, the screwdriver 10 is magnetized. Therefore, the screwdriver 10 can be quickly and conveniently demagnetized and magnetized.

2. In cooperation with the resilient expansion of two lateral resilient sides 25 of the outer casing 20 and the inward contraction of the inclined faces 23 thereof, the metallic stem 11 of the screwdriver 10 with different diameter can be fitted into the screwdriver socket 26. Therefore, the application range of the present invention is wider.

3. The two lateral convex resilient sides 25 and the slightly concave demagnetizing faces 21 of the outer casings 20 enable a user to easily hold and operate the present invention.

The above embodiment is only used to illustrate the present invention, not intended to limit the scope thereof. Many modifications of the above embodiment can be made without departing from the spirit of the present invention.

What is claimed is:

1. Quick magnetizing and demagnetizing device for screwdrivers, comprising two outer casings and two sintered magnets, the outer casings being made of rubber material, an upper and a lower surfaces of each of the outer casings being both formed with slightly concave demagnetizing faces, an upper and a lower sections of the interior of the outer casing being respectively formed with two receiving cavities, a top face and two lateral sides of the upper receiving cavity and a bottom face and two lateral sides of the lower receiving cavity being respectively formed with a certain number of engaging ribs, two outer lateral sides of the central section of the outer casing being convex resilient sides, the interior of the center of the outer casing being formed with an elongated elliptic through hole, an outer end of the through hole forming a screwdriver socket, the sintered magnet being a long rectangular bar having a dimension about twice a dimension of the receiving cavity of the outer casing, under a condition that the identical poles are opposite to each other, the end sections of the two sintered magnets being respectively inserted into the upper and lower receiving cavities of one outer casing, the other end sections of the two magnets being symmetrically inserted into the upper and lower receiving cavities of the other outer casing.

2. Quick magnetizing and demagnetizing device for screwdrivers as claimed in claim 1, wherein when the sintered magnets are inserted into the receiving cavities of the outer casing, the magnet on lower side is lower than the screwdriver socket of the outer casing, while the magnet on upper side is higher than the screwdriver socket of the outer casing, whereby the screwdriver can be inserted into the screwdriver socket without being obstructed.

* * * * *